US010550782B2

(12) United States Patent
Dudar

(10) Patent No.: US 10,550,782 B2
(45) Date of Patent: Feb. 4, 2020

(54) METHOD AND SYSTEM FOR OPERATING AN ENGINE IN HUMID CONDITIONS

(71) Applicant: Ford Global Technologies, LLC, Dearborn, MI (US)

(72) Inventor: Aed Dudar, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 48 days.

(21) Appl. No.: 15/863,459

(22) Filed: Jan. 5, 2018

(65) Prior Publication Data

US 2019/0211764 A1 Jul. 11, 2019

(51) Int. Cl.

| | |
|---|---|
| ***F02D 41/06*** | (2006.01) |
| ***F02N 11/04*** | (2006.01) |
| ***F02N 11/08*** | (2006.01) |
| ***F02N 11/10*** | (2006.01) |
| ***F02N 19/00*** | (2010.01) |
| ***F02P 23/04*** | (2006.01) |

(52) U.S. Cl.

CPC ..... *F02D 41/062* (2013.01); *F02N 11/04* (2013.01); *F02N 11/0803* (2013.01); *F02N 11/10* (2013.01); *F02N 19/005* (2013.01); *F02P 23/04* (2013.01); *F02N 2019/007* (2013.01); *F02N 2200/122* (2013.01)

(58) Field of Classification Search

CPC .... F02D 41/062; F02N 11/04; F02N 11/0803; F02N 11/10; F02N 19/005; F02N 2019/007; F02N 2200/122; F02P 23/04

USPC ..... 123/143 R

See application file for complete search history.

(56) References Cited

U.S. PATENT DOCUMENTS

| | | | | |
|---|---|---|---|---|
| 9,212,970 | B2 | 12/2015 | Martin et al. | |
| 9,255,565 | B2 | 2/2016 | Martin et al. | |
| 2005/0063646 | A1* | 3/2005 | Gupta | F02P 23/04 385/88 |
| 2012/0180744 | A1* | 7/2012 | Gruber | F01P 3/16 123/169 R |
| 2014/0257677 | A1* | 9/2014 | Sangameswaran | F02D 45/00 701/112 |
| 2016/0000015 | A1* | 1/2016 | Bonte | A01F 15/0841 56/341 |
| 2017/0373474 | A1* | 12/2017 | Kanehara | H01T 13/14 |

FOREIGN PATENT DOCUMENTS

| | | | | |
|---|---|---|---|---|
| EP | 2952731 | A1 * | 12/2015 | F02N 11/006 |
| JP | 2007040261 | A * | 2/2007 | |

OTHER PUBLICATIONS

Dudar, A., "Methods and Systems for Removing Moisture From Engine Components," U.S. Appl. No. 15/814,666, filed Nov. 16, 2017, 52 pages.

* cited by examiner

*Primary Examiner* — Mahmoud Gimie

(74) *Attorney, Agent, or Firm* — Geoffrey Brumbaugh; McCoy Russell LLP

(57) ABSTRACT

Methods and systems are provided for improving starting of an engine that has been stopped during humid ambient conditions. The methods and systems may reduce the possibility of starting an engine having liquid water in engine cylinders to improve engine starting. In one example, a laser is applied to a metal surface within the engine to vaporize water that may be in the engine due to condensation.

18 Claims, 5 Drawing Sheets

METHOD AND SYSTEM FOR OPERATING AN ENGINE IN HUMID CONDITIONS

FIELD

The present application relates to methods and systems for operating an internal combustion engine when high ambient humidity levels are present.

BACKGROUND AND SUMMARY

An internal combustion engine of a vehicle may be operated during conditions where ambient humidity levels are high. Humid air may be drawn into the engine while the engine is operating and the engine may perform well because higher temperatures in the engine allow water vapor to remain entrained in air. The higher humidity air acts as a charge diluent and it may be useful to reduce engine knock and NOx emissions. However, if the water vapor is allowed to condense within the engine, it may cause the engine to misfire. Engine emissions and performance may degrade if the engine misfires due to water condensing within the engine.

Water vapor may have a better chance of condensing in the engine if the engine is stopped. In particular, humid air drawn into the engine while the engine was operating may cool after the engine is deactivated. Cooling the humid air may lead to condensation within the engine and formation of water droplets within the engine and the engine air intake system. If the engine is started with water in the engine and/or in the engine air intake, the water may be drawn into engine cylinders via vacuum where it may cause the cylinders to misfire. Therefore, it may be desirable to provide a way of reducing the possibility of liquid water from being drawn into engine cylinders.

The inventor herein has recognized that the challenges associated with operating an engine during humid ambient conditions and has developed an engine operating method, comprising: activating a laser ignition system of an engine and vaporizing water within a cylinder via the laser ignition system in response to an engine start prediction; and rotating the engine in a reverse direction in response to the engine start prediction.

By vaporizing water that may form in an engine cylinder due to condensation, it may be possible to provide the technical result of improving engine starting via reducing the possibility of misfire within the engine. A laser ignition system may be activated in response to a predicted engine start to vaporize water that may be present in engine cylinders. The engine starting prediction may be based on a key fob or other device being within a prescribed distance of the vehicle. Alternatively, the engine start prediction may be based on an opening of a vehicle's door or via a remote vehicle start request.

The approach that is described herein includes several advantages. In particular, the approach may reduce engine emissions. Further, the approach may provide improved combustion during engine starting leading to smoother engine torque production during engine starting. In addition, the approach may improve engine restarts after an engine has been automatically stopped.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
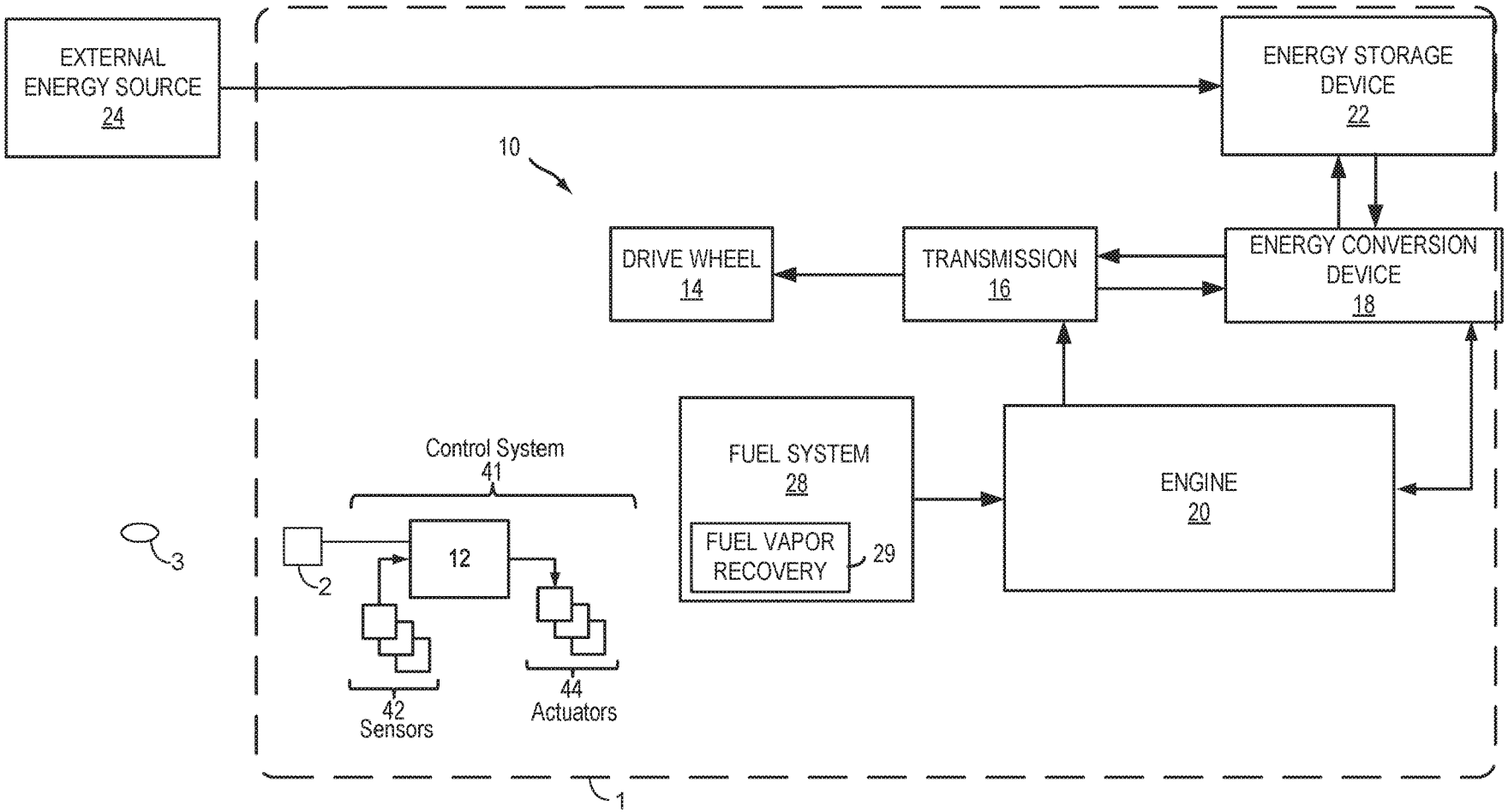
FIG. 1 shows an example hybrid vehicle system.
Figure 2:
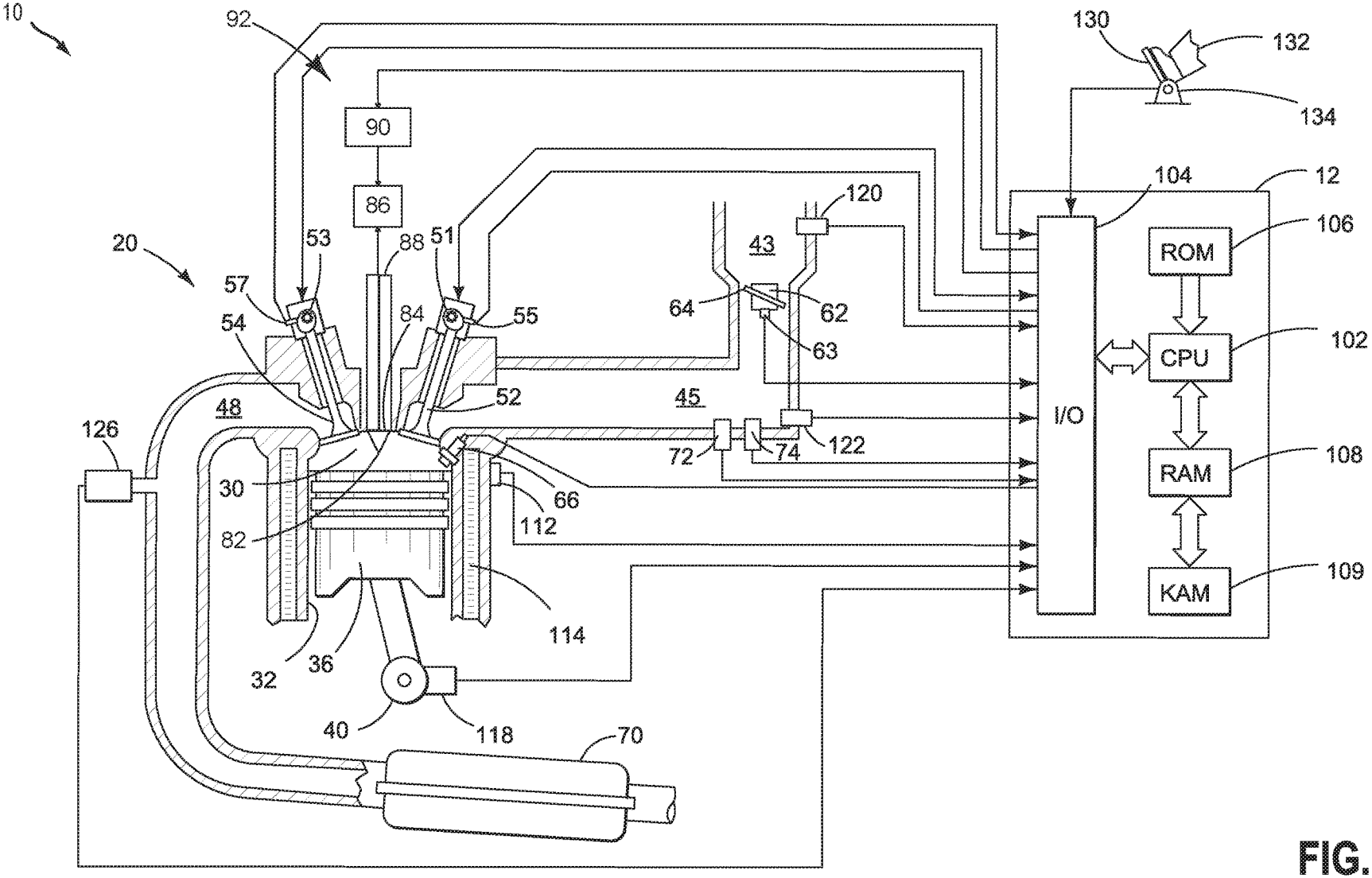
FIG. 2 shows an example internal combustion engine of the hybrid vehicle system of FIG. 1.
Figure 3:
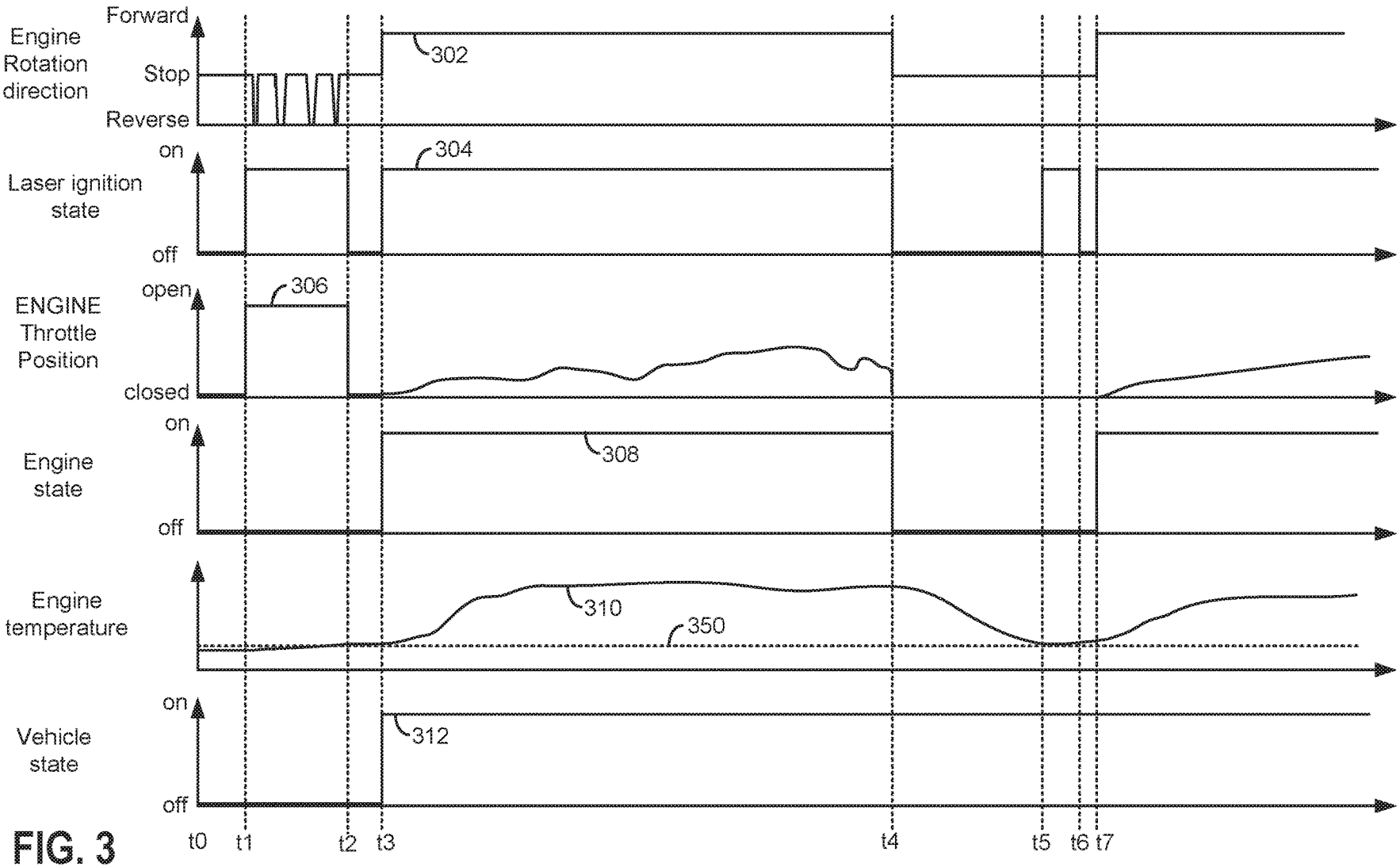
FIG. 3 shows an example engine operating sequence according to the method of FIGS. 4 and 5.
Figure 4:
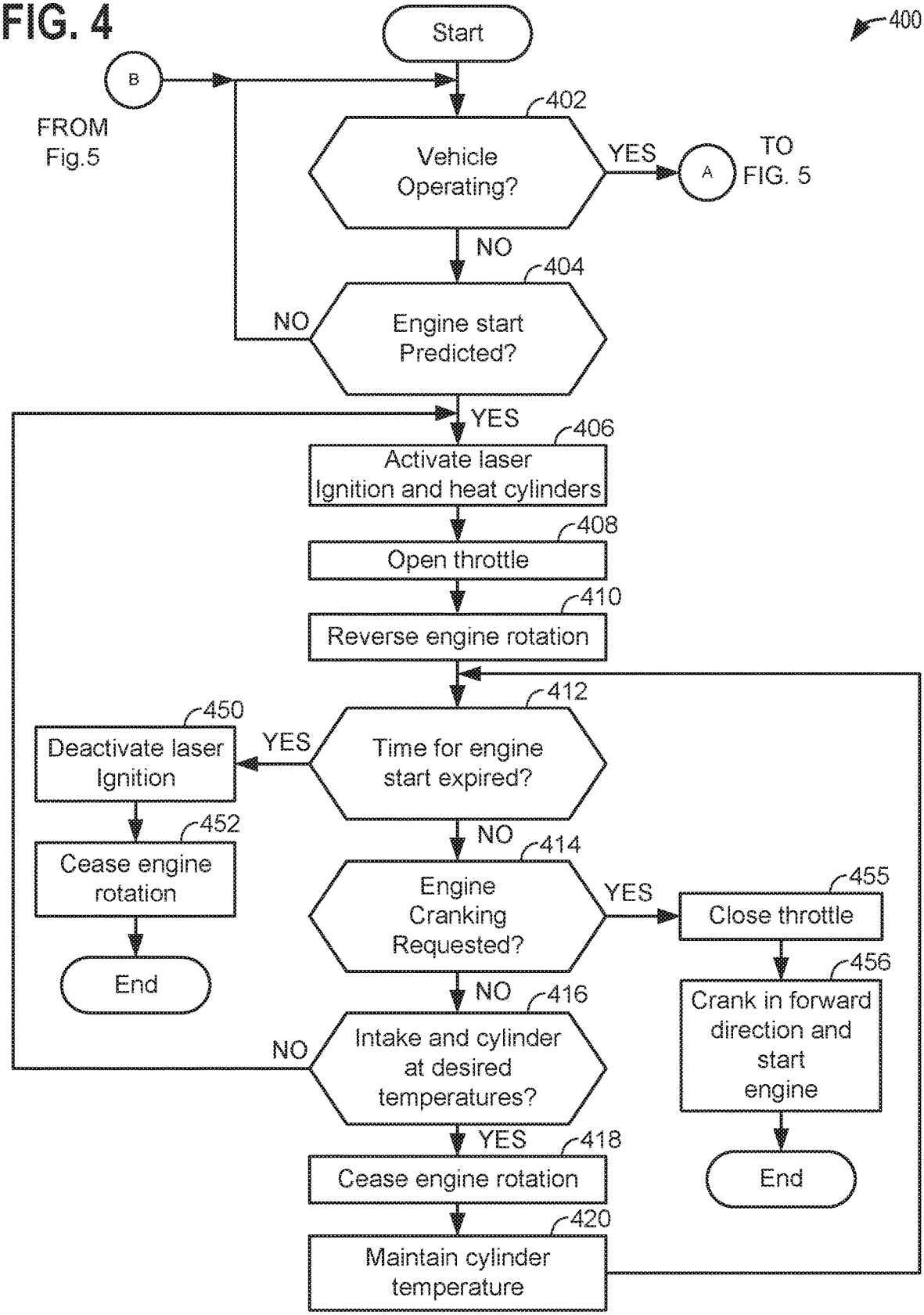
FIGS. 4 and 5 show a high level flow chart of a method for operating an engine.
Figure 5:
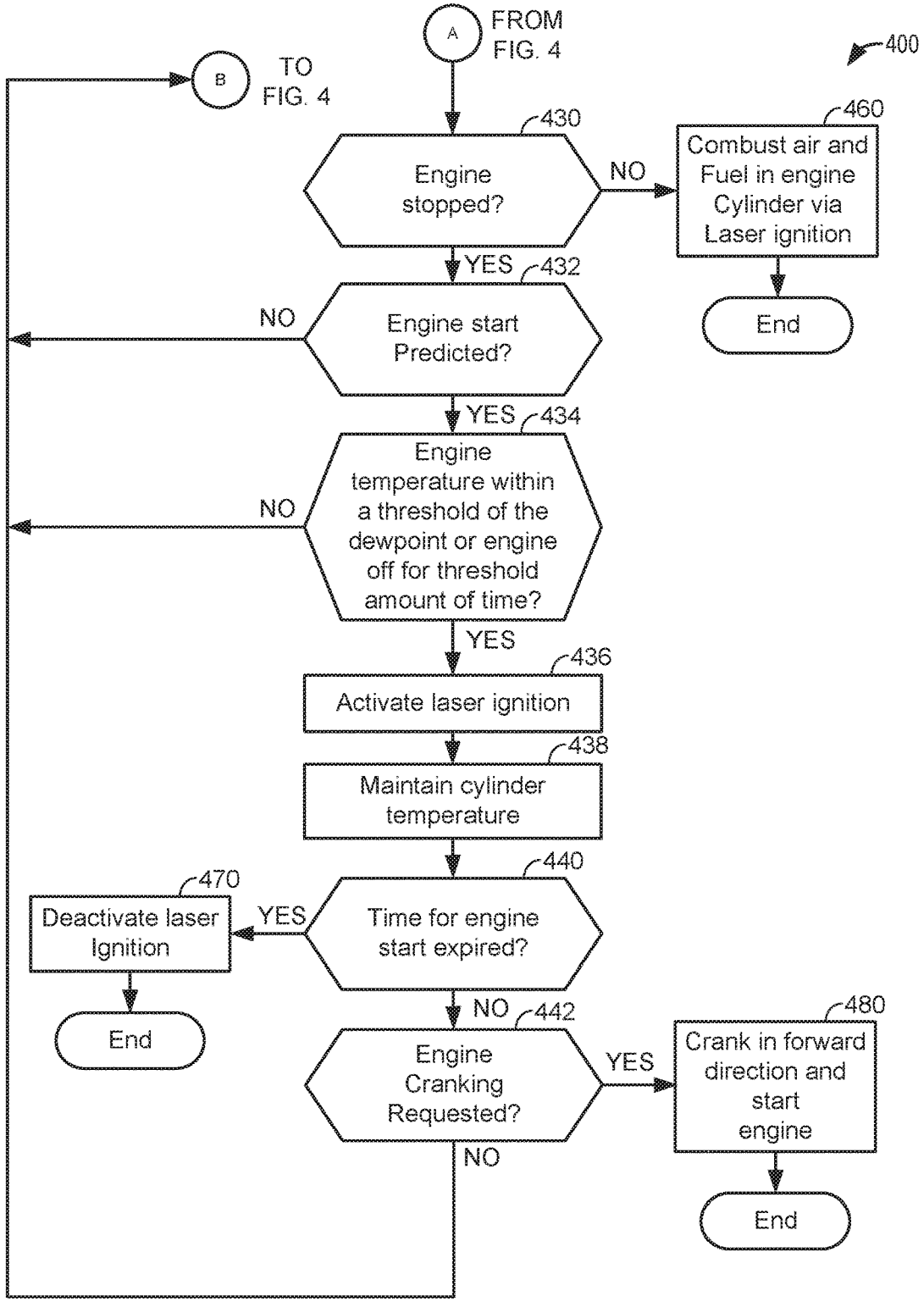

Methods and systems are provided for reducing the formation of water within engine cylinders and improving engine starting are described. FIGS. 1 and 2 show an engine system in which formation of water within engine cylinders may be reduced to improve engine starting. An example engine operating sequence that includes predicting engine starting is shown in FIG. 3. A method for operating an engine that includes a laser ignition system is shown in FIGS. 4 and 5.

FIG. 1 schematically depicts a vehicle with a hybrid propulsion system 10. Hybrid propulsion system 10 includes an internal combustion engine 20 coupled to transmission 16. Transmission 16 may be a manual transmission, automatic transmission, or combinations thereof. Further, various additional components may be included, such as a torque converter, and/or other gears such as a final drive unit, etc. Transmission 16 is shown coupled to drive wheel 14, which may contact a road surface.

In this example, the hybrid propulsion system also includes an energy conversion device or electric machine 18, which may operate as a motor and a generator. The energy conversion device 18 is further shown coupled to an energy storage device 22, which may include a battery, a capacitor, a flywheel, a pressure vessel, etc. The energy conversion device may be operated to absorb energy from vehicle motion and/or the engine and convert the absorbed energy to an energy form suitable for storage by the energy storage device (in other words, provide a generator operation). The energy conversion device may also be operated to supply an output (power, work, torque, speed, etc.) to the drive wheel 14 and/or engine 20 (in other words, provide a motor operation). It should be appreciated that the energy conversion device may operate as both a motor and a generator to providing the appropriate conversion of energy between the energy storage device and the vehicle drive wheels and/or engine 20.

The depicted connections between engine 20, energy conversion device 18, transmission 16, and drive wheel 14 may be mechanical, whereas the connections between the energy conversion device 18 and the energy storage device 22 may be electrical. For example, torque may be transmitted from engine 20 to drive the vehicle drive wheel 14 via transmission 16. As described above energy storage device 22 may be configured to operate in a generator mode and/or a motor mode. In a generator mode, system 10 may absorb some or all of the output from engine 20 and/or transmission 16, which may reduce the amount of drive output delivered to the drive wheel 14. Further, the output received by the energy conversion device 18 may be used to charge energy storage device 22. Alternatively, energy storage device 22 may receive electrical charge from an external energy source 24, such as a plug-in to a main electrical supply. In motor mode, the energy conversion device 18 may supply mechanical output to engine 20 and/or transmission 16, for example by using electrical energy stored in an electric battery.

Hybrid propulsion examples may include full hybrid systems, in which the vehicle can run on just the engine, just the energy conversion device (e.g. motor), or a combination of both. Assist or mild hybrid configurations may also be employed, in which the engine is the primary torque source, with the hybrid propulsion system acting to selectively deliver added torque, for example during high load conditions or other conditions. Further still, starter/generator and/or smart alternator systems may also be used.

From the above, it should be understood that the exemplary hybrid propulsion system is capable of various modes of operation. For example, in a first mode, engine 20 is turned on and acts as the torque source powering drive wheel 14. In this case, the vehicle is operated in an "engine-on" mode and fuel is supplied to engine 20 (depicted in further detail in FIG. 2) from fuel system 28. Fuel system 28 includes a fuel vapor recovery system 29 to store fuel vapors and reduce emissions from the hybrid vehicle propulsion system 10.

In another mode, the propulsion system may operate using energy conversion device 18 (e.g., an electric motor) as the torque source propelling the vehicle. This "engine-off" mode of operation may be employed during braking, low speeds, while stopped at traffic lights, etc. In still another mode, which may be referred to as an "assist" mode, energy conversion device 18 may supplement and act in cooperation with the torque provided by engine 20. As indicated above, energy conversion device 18 may also operate in a generator mode, in which torque is absorbed from engine 20 and/or transmission 16. Furthermore, energy conversion device 18 may act to augment or absorb torque during transitions of engine 20 between different combustion modes (e.g., during transitions between a spark ignition mode and a compression ignition mode).

The various components described above with reference to FIG. 1 may be controlled by a vehicle control system 41, which includes a controller 12 with computer readable instructions for carrying out routines and subroutines for regulating vehicle systems, a plurality of sensors 42, and a plurality of actuators 44. The sensors 42 may include the sensors shown in FIG. 2 as well as a vehicle door position sensor for sensing a state of a driver's door for predicting engine starts. A key fob 3 may transmit a security token (e.g., number sequence) to receiver 2 when key fob 3 enters a proximity (e.g., within two meters) of vehicle 1. The security token may allow activation of vehicle 1 including energy conversion device 18 and engine 20. An engine start may be predicted when fob 3 is within a predetermined distance of vehicle 1 (e.g., after fob 3 transmits the security token to receiver 2 via radio frequency).

FIG. 2 shows a schematic diagram of an example cylinder of multi-cylinder internal combustion engine 20 included in a hybrid vehicle system, such as the hybrid vehicle of FIG. 1. Engine 20 may be controlled at least partially by a control system including controller 12 and by input from a human operator 132 via an input device 130. In this example, input device 130 includes an accelerator pedal and a pedal position sensor 134 for generating a proportional pedal position signal. Controller 12 receives signals from the various sensors shown in FIGS. 1 and 2. Controller 12 also provides signals to the various actuators shown in FIGS. 1 and 2. Controller 12 operates according to executable instructions stored in non-transitory memory.

Combustion cylinder 30 of engine 20 may include combustion cylinder walls 32 with piston 36 positioned therein. Piston 36 may be coupled to crankshaft 40 so that reciprocating motion of the piston is translated into rotational motion of the crankshaft. Crankshaft 40 may be coupled to at least one drive wheel of a vehicle via an intermediate transmission system. Combustion cylinder 30 may receive intake air from intake manifold 45 via intake passage 43 and may exhaust combustion gases via exhaust passage 48. Intake manifold 45 and exhaust passage 48 can selectively communicate with combustion cylinder 30 via respective intake valve 52 and exhaust valve 54. In some examples, combustion cylinder 30 may include two or more intake valves and/or two or more exhaust valves.

In this example, intake valve 52 and exhaust valve 54 may be controlled by cam actuation via respective cam actuation systems 51 and 53. Cam actuation systems 51 and 53 may each include one or more cams and may utilize one or more of cam profile switching (CPS), variable cam timing (VCT), variable valve timing (VVT) and/or variable valve lift (VVL) systems that may be operated by controller 12 to vary valve operation. To enable detection of cam position, cam actuation systems 51 and 53 should have toothed wheels. The position of intake valve 52 and exhaust valve 54 may be determined by position sensors 55 and 57, respectively. In alternative examples, intake valve 52 and/or exhaust valve 54 may be controlled by electric valve actuation. For example, cylinder 30 may alternatively include an intake valve controlled via electric valve actuation and an exhaust valve controlled via cam actuation including CPS and/or VCT systems.

Fuel injector 66 is shown coupled directly to combustion cylinder 30 for injecting fuel directly therein in proportion to the pulse width of signal received from controller 12. In this manner, fuel injector 66 provides what is known as direct injection of fuel into combustion cylinder 30. The fuel injector may be mounted on the side of the combustion cylinder or in the top of the combustion cylinder, for example. Fuel may be delivered to fuel injector 66 by a fuel delivery system (not shown) including a fuel tank, a fuel pump, and a fuel rail. In some examples, combustion cylinder 30 may alternatively or additionally include a fuel injector arranged in intake passage 43 in a configuration that provides what is known as port injection of fuel into the intake port upstream of combustion cylinder 30.

Intake passage 43 may include a throttle 62 having a throttle plate 64. In this particular example, the position of throttle plate 64 may be varied by controller 12 via a signal provided to an electric motor or actuator included with throttle 62, a configuration that may be referred to as electronic throttle control (ETC). In this manner, throttle 62 may be operated to vary the intake air provided to combustion cylinder 30 among other engine combustion cylinders. Intake passage 43 may include a mass air flow sensor 120, a manifold air pressure sensor 122, an intake air temperature sensor 72, and an intake air humidity sensor 74 for providing respective signals to controller 12.

Exhaust gas sensor 126 is shown coupled to exhaust passage 48 upstream of catalytic converter 70. Sensor 126 may be any suitable sensor for providing an indication of exhaust gas air/fuel ratio such as a linear oxygen sensor or UEGO (universal or wide-range exhaust gas oxygen), a two-state oxygen sensor or EGO, a HEGO (heated EGO), a $NO_x$, HC, or CO sensor. The exhaust system may include light-off catalysts and underbody catalysts, as well as exhaust manifold, upstream and/or downstream air/fuel ratio sensors. Catalytic converter 70 can include multiple catalyst bricks, in one example. In another example, multiple emission control devices, each with multiple bricks, can be used. Catalytic converter 70 can be a three-way type catalyst in one example.

Controller 12 is shown in FIG. 1 as a microcomputer, including microprocessor unit 102, input/output ports 104, an electronic storage medium for executable programs and calibration values shown as read-only memory chip 106 in this particular example, random access memory 108, keep alive memory 109, and a data bus. The controller 12 may receive various signals and information from sensors coupled to engine 20, in addition to those signals previously discussed, including measurement of inducted mass air flow from mass air flow sensor 120; engine coolant temperature from temperature sensor 112 coupled to cooling sleeve 114; in some examples, a profile ignition pickup signal from Hall effect sensor 118 (or other type) coupled to crankshaft 40 may be optionally included; throttle position from a throttle position sensor 63; and manifold absolute pressure (MAP) signal from MAP air pressure sensor 122. Storage medium read-only memory chip 106 can be programmed with computer readable data representing instructions executable by microprocessor 102 for performing the methods described below as well as variations thereof.

Engine 20 further includes a laser system 92. Laser system 92 includes a laser exciter 88 and a laser control unit (LCU) 90. LCU 90 causes laser exciter 88 to generate laser energy. LCU 90 may receive operational instructions from controller 12. Laser exciter 88 includes a laser oscillating portion 86 and a light converging portion 84. The light converging portion 84 converges laser light generated by the laser oscillating portion 86 on a laser focal point 82 of combustion cylinder 30.

Laser system 92 is configured to operate in more than one capacity. For example, during combusting conditions, laser energy may be utilized for igniting an air/fuel mixture at a particular crankshaft angle during a compression stroke of the engine, including during engine cranking, engine warm-up operation, and warmed-up engine operation. Fuel injected by fuel injector 66 may form an air/fuel mixture during at least a portion of an intake stroke, where igniting of the air/fuel mixture with laser energy generated by laser exciter 88 commences combustion of the otherwise non-combustible air/fuel mixture and drives piston 36 downward.

As another example, during non-combusting conditions, when temperature within engine 20 is within a threshold temperature of a dewpoint temperature within the engine, the laser ignition system 92 may be activated to heat piston 36 or another surface within engine 20. Laser energy may heat piston 36 causing water droplets within engine 20 to evaporate. The evaporated water may be evacuated from the engine by rotating the engine in a reverse direction during some conditions. LCU 90 may direct laser exciter 88 to focus laser energy at different locations and at different power levels depending on operating conditions. For example, during combusting conditions, the laser energy may be focused at piston 36 and away from cylinder wall 32. In another example, laser energy may be focused at piston 36 and then at cylinder walls 32 to vaporize water droplets.

Controller 12 controls LCU 90 and has non-transitory computer readable storage medium including code to adjust the location of laser energy delivery based on temperature, for example the intake air temperature. Laser energy may be directed at different locations within cylinder 30. Controller 12 may also incorporate additional or alternative sensors for determining the operational mode of engine 20, including additional temperature sensors, pressure sensors, humidity sensors as well as sensors that detect engine rotational speed, air amount and fuel injection quantity. Additionally or alternatively, LCU 90 may directly communicate with various sensors, such as temperature sensors for detecting the ECT, for determining the operational mode of engine 20.

As described above, FIG. 1 shows only one cylinder of a multi-cylinder engine, and each cylinder may similarly include its own set of intake/exhaust valves, fuel injector, laser ignition system, etc.

The system of FIGS. 1 and 2 provides for a vehicle system comprising: an engine including a throttle; an electric motor-generator; a laser ignition system coupled to a cylinder head; and a controller including executable instructions to deactivate a laser ignition system and close the throttle in response to an amount of time to start an engine since predicting an engine start expiring. The system further comprises additional instructions to activate the laser ignition system in response to a prediction of starting the engine. The system further comprises additional instructions to automatically stop rotation of the engine. The system further comprises activating the laser ignition system while the engine is stopped in response to a temperature within the engine being within a threshold of a dewpoint temperature. The system further comprises additional instructions to open the throttle in response to a prediction of starting the engine.

Referring now to FIG. 3, an example engine operating sequence is shown. The sequence of FIG. 3 may be provided via the system of FIGS. 1 and 2. Further, the sequence of FIG. 3 may be provided according to the method of FIGS. 4 and 5.

The first plot from the top of FIG. 3 is a plot of the engine's direction of rotation versus time. The vertical axis represents the engine's direction of rotation and the engine's direction of rotation may be forward (e.g., clockwise) or reverse (e.g., counterclockwise) as indicated along the vertical axis. The engine is stopped when trace 302 is in the middle part of the vertical axis. The horizontal axis represents time and time increases from the left side of the figure to the right side of the figure. Trace 302 represents the engine's direction of rotation.

The second plot from the top of FIG. 3 is a plot of the laser ignition state versus time. The vertical axis represents the laser ignition state and the laser ignition state is on or activated when trace 304 is near the vertical axis arrow. The laser ignition state is off or deactivated when trace 304 is near the horizontal axis. The horizontal axis represents time and time increases from the left side of the figure to the right side of the figure. Trace 304 represents the laser ignition state.

The third plot from the top of FIG. 3 is a plot of engine throttle position versus time. The vertical axis represents engine throttle position and the engine throttle is open when trace 306 is near the vertical axis arrow. The engine throttle is closed when trace 306 is near the horizontal axis. The horizontal axis represents time and time increases from the left side of the figure to the right side of the figure. Trace 306 represents engine throttle position.

The fourth plot from the top of FIG. 3 is a plot of the engine state versus time. The vertical axis represents engine state and engine is on or activated when trace 308 is near the vertical axis arrow. The engine is off or deactivated when trace 308 is near the horizontal axis. The horizontal axis represents time and time increases from the left side of the figure to the right side of the figure. Trace 308 represents engine state.

The fifth plot from the top of FIG. 3 is a plot of the engine temperature versus time. The vertical axis represents a temperature of the engine (e.g., temperature in the engine air intake, temperature in a cylinder, temperature in the intake manifold, or temperature within an intake air runner). The horizontal axis represents time and time increases from the left side of the figure to the right side of the figure. Trace 310 represents engine temperature. Horizontal line 350 represent a dewpoint temperature within the engine at present engine operating conditions.

The sixth plot from the top of FIG. 3 is a plot of vehicle operating state versus time. The vertical axis represents vehicle operating state and the vehicle operating state is on or activated when trace 312 is near the vertical axis arrow. The vehicle is off or deactivated when trace 312 is near the horizontal axis. The horizontal axis represents time and time increases from the left side of the figure to the right side of the figure. Trace 312 represents the vehicle operating state. The vehicle operating state may be active when the engine is deactivated.

At time t0, engine rotation is stopped and the laser ignition system is deactivated. The engine throttle is closed and the engine is off. The engine temperature is below the dewpoint temperature 350 so water may droplets may have formed within the engine due to condensation. In particular, warm air that is drawn into the engine when the engine is being shutdown may cool such that water vapor condenses to form liquid water within the engine intake system. The liquid water may cause the engine to misfire, thereby increasing engine emissions.

At time t1, the engine remains stopped, but the laser ignition is activated in response to an engine start being predicted. The engine start may be predicted when a human opens a vehicle door or enters the proximity of the vehicle with a key fob that provides a security token to the vehicle's controller. The engine throttle is also opened in response to the engine start prediction. By opening the throttle, air may flow from the engine into the engine air intake to allow water that was heated in the engine to vaporize or evaporate and transfer the water vapor from warmer parts of the engine to cooler parts of the engine including the engine intake system upstream of the throttle. The warmed air from in the engine may help water to evaporate in the engine head and air intake so that a volume of heated air in the engine increases before engine starting. The heated air may reduce the amount of water droplets inducted to the engine during a first few combustion events since the most recent engine stop so that the possibility of engine misfire may be reduced. The engine remains deactivated and the engine temperature remains below the dewpoint temperature. The vehicle remains off (e.g., torque propulsion sources such as the engine and energy conversion device are not activated).

Between time t1 and time t2, the engine is rotated in a reverse direction several times where the engine is stopped before and after each engine rotation. By rotating the engine in reverse, air that is heated within the engine may be retained within the engine air intake where it may help to evaporate water droplets in the engine air intake. If the engine were rotated in a forward direction, heated air would be expelled to the exhaust system where it would be of no usefulness to remove water droplets from the engine air intake. The engine is reverse rotated to exhaust contents of a cylinder to the engine air intake where it may help to evaporate water that may be in the engine air intake. Further, the contents of one cylinder may be exhausted to the engine intake, then the engine may be stopped to heat the contents of a different cylinder, and then the engine may be rotated again to exhaust the contents of the different cylinder to the engine air intake. Thus, heating of cylinders may be performed while the engine is stopped, and then heated contents of the engine cylinders including water vapor may be expelled to the engine air intake via reverse rotating the engine. In this way, heat produced in engine cylinders via the activated laser system may vaporize water in engine cylinders and promote evaporation of water in the engine air intake. The engine throttle remains open and the engine remains in an off state while the laser ignition is activated and the engine is rotated in the reverse direction. The vehicle also remains off. The engine temperature increases as the laser system heats air within engine cylinders and the engine air intake.

At time t2, the engine temperature exceeds the dewpoint temperature in the engine by a threshold amount and the laser ignition system is deactivated to reduce energy consumption. The engine throttle is closed in response to the engine temperature being greater than the dewpoint temperature and the engine remains off. The vehicle also remains deactivated and engine rotation is stopped.

At time t3, the engine is rotated in a forward direction in response to a vehicle start request (not shown). The engine and laser ignition system are also activated (e.g., supplied with spark and fuel) in response to the vehicle start request. The engine is started with the throttle closed and the vehicle is activated (e.g., power is supplied to the vehicle propulsion sources) in response to the vehicle start request.

Between time t3 and time t4, the engine operates and the engine temperature increases. When engine temperature increases, there may be less possibility of water droplets forming in the engine air intake since temperature in the engine may be above the dewpoint temperature. The vehicle remains activated and the engine throttle is opened and closed responsive to the driver demand torque (not shown). The laser ignition remains activated to support combustion within the engine and the engine is rotated in a forward direction.

At time t4, engine rotation is stopped while the vehicle remains activated. The engine may be automatically stopped (e.g., stopped engine rotation in response to vehicle inputs other than a dedicated driver input, such as a key switch or pushbutton, to stop the engine) via the controller to conserve fuel when driver demand torque is low. The throttle is closed and the laser ignition system is deactivated in response to the automatic engine stop. The engine temperature is at a higher level.

Between time t4 and time t5, the engine temperature declines and the vehicle remains activated. The engine remains stopped and the engine is not rotating. The laser ignition remains deactivated and the engine throttle remains closed.

At time t5, engine temperature is within a threshold temperature of dewpoint temperature 350. Therefore, the laser ignition is activated to heat contents of engine cylinders. The laser generates heat within the engine when the laser is directed on a metallic surface (e.g., a piston or cylinder wall) within the engine. The heating may prevent condensation within the engine cylinders so that water droplets do not form within the engine. By reducing the possibility of water droplets forming in the engine, it may be possible to reduce the possibility of misfire within the engine. The engine remains deactivated and it is not rotating. The engine throttle is closed and the vehicle remains activated.

At time t6, the laser ignition is deactivated to conserve electrical energy. The engine remains deactivated and the engine throttle remains closed. The engine temperature has increased above the dewpoint temperature 350 and the vehicle remains activated.

At time t7, the engine is automatically restarted and the engine is rotated in a forward direction. The laser ignition is activated to support combustion within the engine and the engine throttle is closed when the engine is started to limit engine torque output. The engine is started and the engine temperature begins to increase. The vehicle remains activated.

In this way, the laser ignition system may be activated to heat contents of an engine cylinder when water droplets may form within an engine. The laser ignition system may also keep contents of the engine warm during conditions when the engine may be restarted automatically so that water droplets may not form within the engine.

Now turning to FIGS. 4 and 5, routine 400 depicts a method for operating an engine. The method of FIGS. 4 and 5 may be incorporated into and may cooperate with the system of FIGS. 1 and 2. Further, at least portions of the method of FIGS. 4 and 5 may be incorporated as executable instructions stored in non-transitory memory while other portions of the method may be performed via a controller transforming operating states of devices and actuators in the physical world. The engine controller described herein also includes instructions to operate the engine at the conditions described herein.

At 402, the method judges whether or not the vehicle is operating. The vehicle may operate in response to a request by a human driver or an autonomous driver to operate the vehicle. In one example, vehicle operation may be requested when a key fob enters proximity of the vehicle (e.g., within 2 meters of the vehicle) and a key fob transmits a security token that is recognized by the vehicle's controller. One or more of the vehicle's powertrain torque sources (e.g., the engine or an electric machine) may be activated (e.g., supplied with power) when the vehicle is operating. Method 400 may judge that the vehicle is activated when one of the vehicle's propulsion torque sources are activated or when the key fob or a similar device is proximate to the vehicle. If method 400 judges that the vehicle is operating, the answer is yes and method 400 proceeds to 430 of FIG. 5. Otherwise, the answer is no and method 400 proceeds to 404.

At 404, method 400 judges if an engine start is predicted. Method 400 may predict that an engine of the vehicle will start when a door of the vehicle opens or when a key fob is within a predetermined distance of the vehicle. The door opening or the key fob entering the proximity of the vehicle may be precursor events that may be used to predict an engine start. Battery state of charge and driver demand torque may also be conditions from which an engine start may be predicted. It may be desirable to predict engine starting before an actual engine start is requested so that contents (e.g., air and water droplets) of the engine may be heated before the engine start. By heating the contents of the cylinder, it may be possible to reduce the possibility of engine misfires due to water droplets in the cylinder. The water droplets may result from warm humid air condensing in the engine when the engine is stopped and engine temperature is reduced. If method 400 predicts an engine start, the answer is yes and method 400 proceeds to 406. Otherwise, method 400 returns to 402. If an engine start is not predicted it may be desirable to conserve electrical energy by not activating the laser.

At 406, method 400 activates the laser ignition system and heats engine components via focusing laser energy on metallic surfaces (e.g., pistons) within the engine. The amount of power output from the laser may be adjusted responsive to temperature within engine cylinders. Temperature within engine cylinders may be inferred from intake manifold temperature, or it may be directly measured. The laser ignition system may be activated by supplying the laser ignition system with electrical power via an electric energy storage device. Method 400 proceeds to 408.

At 408, method 400 opens the engine throttle (e.g., 62 of FIG. 1). The throttle may be opened to allow heated air from engine cylinders to flow into the engine intake from engine cylinders when the engine is rotated in a reverse direction so that water droplets that may be in the engine intake may be heated to facilitate evaporation of the water droplets. Method 400 proceeds to 410.

At 410, method 400 rotates the engine in a reverse direction. The reverse direction is opposite to the direction that the engine rotates when the engine is combusting air and fuel (e.g., clockwise). By rotating the engine in a reverse direction, contents of engine cylinders (e.g., air and water vapor) may be evacuated to the engine air intake where the heated contents may help to facilitate evaporation of water from the engine intake system instead of losing the heat energy in the exhaust system. The engine may be rotated in the reverse direction via an electric machine (e.g., the energy conversion device). The engine is not combusting air and fuel when it is rotated in the reverse direction.

The engine may be continuously rotated in the reverse direction or it may be rotated in the reverse direction to evacuate contents of a single cylinder to the engine intake before stopping engine rotation to allow further heating of contents in other engine cylinders as is shown in FIG. 3. For example, for a four cylinder four stroke engine, method 400 may reverse rotate the engine for 180 crankshaft degrees to evacuate the contents of an engine cylinder to the intake manifold. Once contents of the cylinder are evacuated to the engine intake, the engine is stopped and contents of engine cylinders are heater further. Then, the engine is rotated in reverse for another 180 crankshaft degrees to evacuate contents of a different engine cylinder, then engine rotation is stopped. This process may be repeated several times. Method 400 proceeds to 412.

At 412, method 400 judges if a threshold amount of time to perform an engine start since predicting an engine start has expired. In other words, method 400 may judge if an amount of time since predicting an engine start at 404 has elapsed without an engine start being requested. In one example, the threshold amount of time may be adjusted in response to engine operating conditions. For example, if the vehicle has just been activated after a long period of being deactivated, the threshold amount of time may be short. Further, if the state of battery charge is high, the threshold amount of time to start the engine after the vehicle has been activated may be long. If the state of battery charge is low, the threshold amount of time to start the engine after the vehicle has been activated may be short. If method 400 judges that the threshold amount of time to start the engine since the engine start was predicted has expired, the answer is yes and method 400 proceeds to 450. Otherwise, the answer is no and method 400 proceeds to 414.

At 450, method 400 deactivates the laser ignition system. The laser ignition system may be deactivated via ceasing to supply electrical power to the laser ignition system. Method 400 proceeds to 452.

At 452, method 400 ceases to rotate the engine in the reverse direction. If the energy conversion device is activated, method 400 may deactivate the energy conversion device. Method 400 proceeds to exit.

At 414, method 400 judges if engine cranking (e.g., rotating the engine via the energy conversion device at a speed less than engine idle speed) is requested. In one example, method 400 may judge that engine cranking is requested if battery state of charge is less than a threshold. Alternatively or additionally, method 400 may judge that engine cranking is requested if driver demand torque is greater than a threshold. If method 400 judges that engine cranking is requested, the answer is yes and method 400 proceeds to 455. Otherwise, the answer is no and method 400 proceeds to 416.

At 455, method 400 closes the engine throttle. The engine throttle is closed to limit engine torque during engine cranking. Method 400 proceeds to 456.

At 456, method 400 cranks the engine in a forward direction to start the engine. The engine may be rotated via the energy conversion device or an engine starter. Spark and fuel are also supplied to the engine to start the engine. Method 400 proceeds to exit after cranking and starting the engine.

At 416, method 400 judges if engine temperatures are at desired levels. In one example, the engine temperature is a temperature within an engine cylinder. In another example, the engine temperature is a temperature in an engine intake manifold. In still another example, the engine temperature is a temperature in the engine air intake system upstream of the engine throttle. If method 400 judges that one or more engine temperatures are at desired temperatures (e.g., a threshold temperature above the dewpoint temperature), the answer is yes and method 400 proceeds to 418. Otherwise, the answer is no and method 400 returns to 406.

At 418, method 400 ceases to rotate the engine in the reverse direction (e.g., direction opposite of the direction the engine rotates when the engine is combusting air and fuel). The engine rotation may be ceased via stopping to supply electrical power to the energy conversion device. Method 400 proceeds to 420.

At 420, method 400 maintains temperature in the engine. The temperature in the engine may be maintained by selectively activating and deactivating the laser ignition system to maintain temperature within the engine. If the engine starts to cool more than is desired, then the laser ignition system may be activated. If the engine temperature is increasing more than is desired, then the laser ignition system may be deactivated. Method 400 returns to 412.

At 430, method 400 judges if engine rotation is stopped. Engine rotation may automatically stopped to conserve fuel in response to driver demand torque being less than a threshold torque while battery state of charge is greater than a threshold charge. Further, engine rotation may be automatically stopped in response to the vehicle being stopped and/or the vehicle traveling on a road having a negative grade. Method 400 may automatically stop the engine without a driver specifically requesting an engine stop via a controller input that is dedicated to receiving human driver input to stop the engine (e.g., an ignition switch or push-button). Method 400 may judge that engine rotation is stopped when engine position does not change for a predetermined amount of time. If method 400 judges that the engine is stopped, the answer is yes and method 400 proceeds to 432. Otherwise, the answer is no and method 400 proceeds to 460.

At 460, the engine is operated by combusting air and fuel within the engine via the laser ignition system. Air is provided to the engine via opening the throttle and fuel is supplied to the engine via fuel injectors. The fuel and air is ignited via the laser ignition system. Method 400 proceeds to exit.

At 432, method 400 judges if an engine start is predicted. Method 400 may predict that an engine of the vehicle will start when battery state of charge is reduced to less than a threshold amount of charge. For example, if battery state of charge is 40%, battery charge is being reduced at a rate of 1% per minute, and the engine is started at 30% battery state of charge to recharge the battery, method 400 may predict that the engine will be restarted within 10 minutes. Similarly, method 400 may predict that the engine will restart due to increasing driver demand torque. For example, if driver demand torque is 100 Newton-meters, increasing at 10 Newton-meters per second, and the engine is started at 200 Newton-meters of requested torque, method 400 may predict that the engine will be started in 10 seconds. The engine start may be predicted for up to a predetermined amount of time (e.g., 10 minutes). If method 400 predicts or forecasts an engine start within a predetermined amount of time, the answer is yes and method 400 proceeds to 434. Otherwise, the answer is no and method 400 returns to 402.

At 434, method 400 judge is engine temperature is within a threshold temperature of the dewpoint temperature within the engine or if the engine is stopped (not rotating) for more than a threshold amount of time. If the engine temperature is within a threshold temperature of the dewpoint temperature within the engine, the water vapor in the engine may be about to condense within the engine. Alternatively, if the dewpoint within the engine may not be reliably determined, due to a degraded sensor for example, then method 400 may judge if the engine has been stopped for a predetermined amount of time to estimate whether or not condensation may be forming within the engine. If method 400 judges that engine temperature is within a threshold temperature of the dewpoint temperature within the engine or if the engine is stopped (not rotating) for more than a threshold amount of time, the answer is yes and method 400 proceeds to 436. Otherwise, the answer is no and method 400 returns to 402.

At 436, method 400 activates the laser ignition system and heats engine components via focusing laser energy on metallic surfaces (e.g., pistons) within the engine. The amount of power output from the laser may be adjusted responsive to temperature within engine cylinders. Temperature within engine cylinders may be inferred from intake manifold temperature, or it may be directly measured. The laser ignition system may be activated by supplying the laser ignition system with electrical power via an electric energy storage device. Method 400 proceeds to 438.

At 438, method 400 maintains temperature in the engine. The temperature in the engine may be maintained by selectively activating and deactivating the laser ignition system to maintain temperature within the engine. If the engine starts to cool more than is desired, then the laser ignition system may be activated. If the engine temperature is increasing more than is desired, then the laser ignition system may be deactivated. Method 400 proceeds to 440.

At 440, method 400 judges if a threshold amount of time to perform an engine start since predicting an engine start has expired. In other words, method 400 may judge if an amount of time since predicting an engine start at 432 has elapsed without an engine start being requested. In one example, the threshold amount of time may be adjusted in response to engine operating conditions. For example, if the vehicle has just been activated after a long period of being deactivated, the threshold amount of time may be short. Further, if the state of battery charge is high, the threshold amount of time to start the engine after the vehicle has been activated may be long. If the state of battery charge is low, the threshold amount of time to start the engine after the vehicle has been activated may be short. If method 400 judges that the threshold amount of time to start the engine since the engine start was predicted has expired, the answer is yes and method 400 proceeds to 470. Otherwise, the answer is no and method 400 proceeds to 442.

At 470, method 400 deactivates the laser ignition system. The laser ignition system may be deactivated via ceasing to supply electrical power to the laser ignition system. Method 400 proceeds to exit.

At 442, method 400 judges if engine cranking (e.g., rotating the engine via the energy conversion device at a speed less than engine idle speed) and engine starting is requested. In one example, method 400 may judge that engine cranking and starting is requested if battery state of charge is less than a threshold. Alternatively or additionally, method 400 may judge that engine cranking and starting is requested if driver demand torque is greater than a threshold. If method 400 judges that engine cranking and starting is requested, the answer is yes and method 400 proceeds to 480. Otherwise, the answer is no and method 400 returns to 402.

At 480, method 400 cranks the engine in a forward direction to start the engine. The engine may be rotated via the energy conversion device or an engine starter. Spark and fuel are also supplied to the engine to start the engine. Method 400 proceeds to exit after cranking and starting the engine.

In this way, energy from a laser ignition system may be applied to an engine to heat contents of engine cylinders and the engine air intake to reduce liquid fuel within the engine. By reducing liquid fuel within the engine and intake system, the possibility of engine misfires may be reduced.

The method of FIGS. 4 and 5 provides for an engine operating method, comprising: receiving sensor input to a controller to predict an engine start; activating a laser ignition system of an engine and vaporizing water within a cylinder via the laser ignition system in response to an engine start prediction; and rotating the engine in a reverse direction in response to the engine start prediction. The method includes where activating the laser ignition system includes operating the laser ignition device to direct laser pulses into the cylinder. The method includes where the laser ignition system is activated in further response to an estimate of condensation within the cylinder. The method includes where the estimate of condensation is based on a dewpoint temperature.

In some examples, the method further comprises opening an engine throttle in response to the engine start prediction. The method includes where the engine is rotated in a reverse direction via an electric machine. The method further comprises deactivating the laser ignition system when the engine is not started within a threshold amount of time of predicting the engine start. The method further comprises reversing engine rotation so that the engine rotates in a forward direction in response to an engine start request. The method further comprises closing an engine throttle in response to the engine start request.

The method of FIGS. 4 and 5 also provides for an engine operating method, comprising: automatically stopping rotation of an engine; and activating a laser ignition system while the engine is stopped immediately following the automatic engine stop in response to a temperature within the engine being within a threshold of a dewpoint temperature. The method further comprises estimating a dewpoint temperature within the engine. The dewpoint temperature may be estimated via known methods. The method includes where estimating the dewpoint temperature includes estimating humidity within the engine. The method further comprises deactivating the laser ignition system in response to the engine not being started within a threshold amount of time of activating the laser ignition system. The method further comprises opening a throttle of the engine in response to the temperature within the engine being within the threshold of the dewpoint temperature. The method further comprises automatically restarting the engine in response to the temperature within the engine being within the threshold temperature of the dewpoint temperature.

Note that the example control and estimation routines included herein can be used with various engine and/or vehicle system configurations. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example examples described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system.

It will be appreciated that the configurations and routines disclosed herein are exemplary in nature, and that these specific examples are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. An engine operating method, comprising:

activating a laser ignition system of an engine and vaporizing water within a cylinder via the laser ignition system in response to an engine start prediction;

rotating the engine in a reverse direction in response to the engine start prediction; and deactivating the laser ignition system when the engine is not started within a threshold amount of time of predicting the engine start.

2. The method of claim 1, where activating the laser ignition system includes operating a laser ignition device to direct laser pulses into the cylinder in response to a temperature within the engine being within a threshold of a dewpoint temperature, and estimating the dewpoint temperature within the engine.

3. The method of claim 1, where the laser ignition system is activated in further response to an estimate of condensation within the cylinder.

4. The method of claim 3, where the estimate of condensation is based on a dewpoint temperature.

5. The method of claim 1, further comprising opening an engine throttle in response to the engine start prediction.

6. The method of claim 1, where the engine is rotated in a reverse direction via an electric machine.

7. The method of claim 1, further comprising reversing engine rotation so that the engine rotates in a forward direction in response to an engine start request.

8. The method of claim 7, further comprising closing an engine throttle in response to the engine start request.

9. An engine operating method, comprising:

automatically stopping rotation of an engine; and activating a laser ignition system while the engine is stopped in response to a temperature within the engine being within a threshold of a dewpoint temperature; and automatically restarting the engine in response to the temperature within the engine being within the threshold temperature of the dewpoint temperature.

10. The method of claim 9, further comprising estimating the dewpoint temperature within the engine.

11. The method of claim 10, where estimating the dewpoint temperature includes estimating humidity within the engine.

12. The method of claim 9, further comprising deactivating the laser ignition system in response to the engine not being started within a threshold amount of time of activating the laser ignition system.

13. The method of claim 9, further comprising opening a throttle of the engine in response to the temperature within the engine being within the threshold of the dewpoint temperature.

14. A vehicle system comprising:

an engine including a throttle;

an electric motor-generator;

a laser ignition system coupled to a cylinder head; and a controller including executable instructions to deactivate a laser ignition system and close the throttle in response to expiration of an amount of time to start an engine since predicting an engine start.

15. The system of claim 14, further comprising additional instructions to activate the laser ignition system in response to a prediction of starting the engine.

16. The system of claim 14, further comprising additional instructions to automatically stop rotation of the engine.

17. The system of claim 14, further comprising activating the laser ignition system while the engine is stopped in response to a temperature within the engine being within a threshold of a dewpoint temperature.

18. The system of claim 14, further comprising additional instructions to open the throttle in response to a prediction of starting the engine.

* * * * *